US005318004A

United States Patent [19]

Peck

[11] Patent Number: 5,318,004

[45] **Date of Patent: * Jun. 7, 1994**

[54] ROTATIONALLY ADJUSTABLE BOW STRING RELEASE

[75] Inventor: Paul L. Peck, Fond du Lac, Wis.

[73] Assignee: Tru-Fire Corporation, Fond du Lac, Wis.

[ * ] Notice: The portion of the term of this patent subsequent to May 30, 2011 has been disclaimed.

[21] Appl. No.: 758,778

[22] Filed: Sep. 12, 1991

[51] Int. Cl.[5] ..... F41B 5/00

[52] U.S. Cl. ..... 124/35.2

[58] Field of Search ..... 124/31, 35.1, 35.2

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 3,898,974 | 8/1974 | Keck | 124/35.2 |
| 3,954,095 | 5/1976 | Lewis | 124/35.2 |
| 4,066,060 | 1/1978 | Napier | 124/35.2 |
| 4,257,386 | 3/1981 | Gazzara | 124/35.2 |
| 4,308,851 | 1/1982 | Kaine, Jr. et al. | 124/35.2 |
| 4,392,475 | 7/1983 | Fletcher | 124/35.2 |
| 4,403,594 | 9/1983 | Todd | 124/35.2 |
| 4,485,798 | 2/1984 | Hamm | 124/35.2 |
| 4,489,705 | 12/1984 | Larson | 124/35.2 |
| 4,527,536 | 7/1985 | Smith | 124/35.2 |
| 4,567,875 | 2/1986 | Fletcher | 124/35.2 |
| 4,620,523 | 11/1986 | Peck | 124/35.2 |
| 4,674,469 | 6/1987 | Peck | 124/35.2 |
| 4,691,683 | 9/1987 | Peck | 124/35.2 |
| 4,854,293 | 8/1989 | Roberts | 124/35.2 |
| 4,881,516 | 11/1989 | Peck | 124/35.2 |
| 4,926,835 | 5/1990 | Peck | 124/36.2 |
| 5,027,786 | 7/1991 | Peck | 124/35.2 |

*Primary Examiner*—Peter M. Cuomo
*Assistant Examiner*—Jeffrey L. Thompson
*Attorney, Agent, or Firm*—Robert C. Curfiss

[57] ABSTRACT

A bow string release with a head carrying a pivotable sear movable between a closed string retaining position and an open string releasing position, and a latch for selectively engaging and locking the sear in the string retaining position. The sear includes a roller mounted on one end and the latch includes a tapered pin for engaging the roller when the pin is extended to lock the sear in the closed position. The sear includes a pair of spaced string retaining notches, adapted for engaging the bow string above and below the nock of an arrow, the bow string substantially perpendicular to the axis of the arrow when the string is placed in the release mechanism.

5 Claims, 2 Drawing Sheets

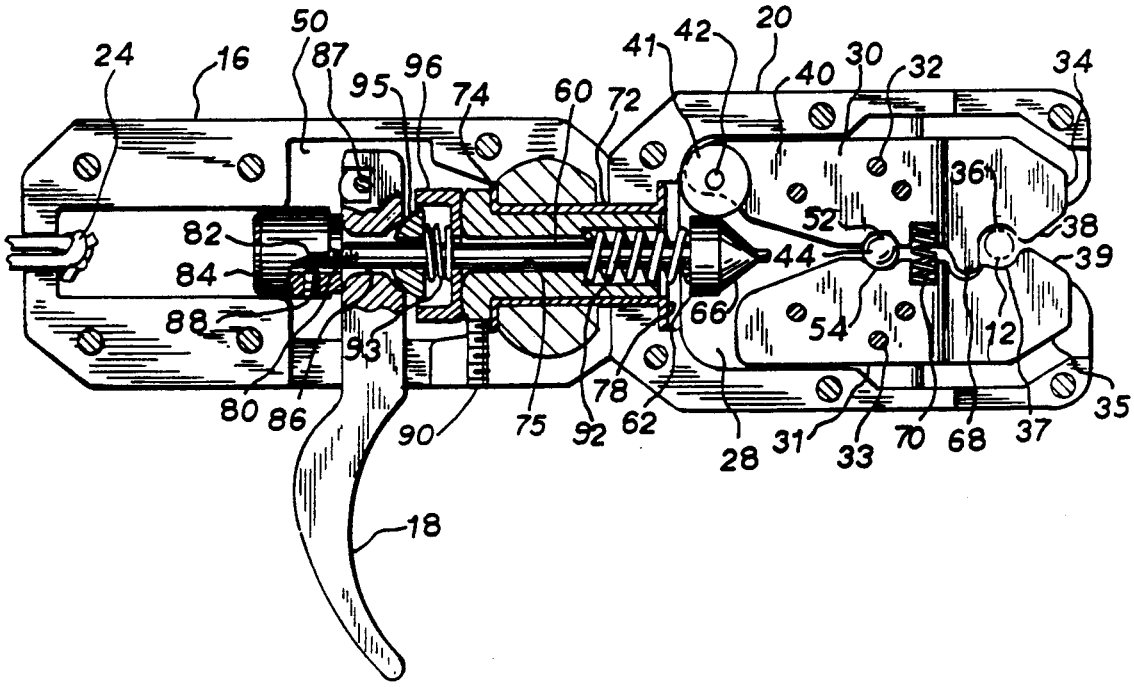

ROTATIONALLY ADJUSTABLE BOW STRING RELEASE

BACKGROUND OF THE INVENTION

1. Field of the Invention

This invention relates generally to bow string releases of the type having a releasable sear for retaining a bow string, and more particularly to a bow string release with a head and trigger having adjustable rotational orientation relative to one another.

2. Description of the Prior Art

This invention is related to my co-pending application Ser. No. 07/758,779 entitled: "Twin Jaw Bow String Release", filed on even date herewith.

In recent years, bow string releases have grown in popularity for both target shooting and hunting. A good release provides uniform control of the bow string and increases accuracy. The release is either hand-held or strapped to the wrist and has a trigger which permits the archer to release the string. Typically, such devices employ a releasable sear that engages the bow string, the sear being movable from a string retaining position to a release position for releasing the string. Releases of this type are illustrated in U.S. Pat. Nos. 4,485,798; 4,066,060; 3,954,095; and 3,898,974. It is also known to use ball type elements in place of the sear to retain and release the string, wherein the ball elements are held by a head and retained in position by a yoke or sleeve. A device of this type is illustrated in U.S. Pat. No. 4,403,594 .

In typical use, the releases are used to maintain the bow string in a cocked position in which the bow string is flexed against the tension of the bow for propelling an arrow supported on the bow string. The arrow includes a notched nock which is configured to receive the bow string to insure stability of the arrow during cocking and release of the bow string. The nock of the arrow is preferably disposed at or near the mid-point of the bow string to insure that the flight of the arrow is as true as possible.

In most applications, the release includes a head incorporating the movable sears for holding and selectively releasing the bow string and a body for housing a trigger which is in communication with the sear mechanism and operable when actuated to open the sear and release the bow string. It is desirable that the rotational orientation of the trigger relative to the sear mechanism be adjustable to accommodate the individual requirements of a variety of users. Typically, the rotational orientation of the sear relative to the trigger is set by the user and is locked in position by locking means such as a set screw or the like. While such devices permit the individual user to adjust the orientation of the trigger and sear to his own individual requirements, it has been found that many users desire a range of calibration since they do not hold the bow and release in precisely the same position at each use. The adjustable devices of the prior art are either of the free rotation type, wherein the orientation cannot be set for the individual user, or are of the locking type wherein once the orientation has been calibrated, it is locked in position.

SUMMARY OF THE INVENTION

The subject invention provides a bow string release with a head carrying a pivotable sear movable between a closed string retaining position and an open string releasing position, and a latch for selectively engaging and locking the sear in the string retaining position.

The subject invention provides for a body which is rotatably adjustable relative to the sear, the body containing a trigger mechanism which is in communication with the sear, whereby activation of the trigger opens the sear to release the bow string. In the preferred embodiment, means are provided for setting the rotational orientation of the body relative to the head, wherein once the orientation is properly set, locking means are provided to limit the rotational movement between the body and the sear, while permitting slight adjustment where desired to accommodate minor changes in position by the user during repeat uses of the bow string release.

In the preferred embodiment, the sear includes a roller mounted on one end and the latch includes a tapered pin for engaging the roller when the pin is extended to lock the sear in the closed position. The roller rides on the tapered pin as it is retracted, permitting pivotable movement of the sear to the open position for releasing the bow string.

The release mechanism of the subject invention may include a single movable sear element adapted for movement between an open and closed position against an abutment on the head of the release, or in the alternative, may include complementary, coacting sear elements which are designed to simultaneously pivot and release the string from the string retaining notch.

It is, therefore, an object of the invention to provide a bow string release having a sear carrying head mounted for rotation relative to a trigger carrying body to provide for selective angular orientation between the string retaining sear and the trigger mechanism.

It is another object of the invention to provide a bow string release wherein the rotational orientation between the sear and the trigger mechanism may be set within a specified range and thereafter calibrated to provide for minor adjustment between uses of the release to accommodate minor variation in orientation without releasing the locking mechanism.

It is also an object of the present invention to provide an improved bow string release mechanism for providing smooth movement of the string retaining sear from a closed string retaining position to an open string releasing position in response to a movement of the release trigger.

Other objects and features of the invention will be readily apparent from the accompanying drawing and description.

BRIEF DESCRIPTION OF THE DRAWING

FIG. 1 is an illustration of a bow string release in accordance with the subject invention and shown as used with a typical bow and arrow.

FIG. 2 is an enlarged plan view of a release mechanism as shown in FIG. 1, shown in the closed, string retaining position with covers removed and with the head rotated 90° from the orientation shown in FIG. 1.

FIG. 3 is a view similar to FIG. 2, showing an alternative embodiment of a bow string release in accordance with the subject invention.

FIG. 4 is a section view taken along line 4—4 of FIG. 3.

FIG. 5 is a view similar to FIG. 4, showing the release in a different angular orientation.

FIG. 6 is a plan view of an alternative embodiment of the bow string release of the present invention shown in the closed, string retaining position, with covers removed and with the head and body in the same orientation as shown in FIG. 2.

FIG. 7 is a section view taken generally along line 7—7 of FIG. 6.

DETAILED DESCRIPTION OF THE PREFERRED EMBODIMENT

As shown in FIG. 1, the bow string release 10 of the subject invention is adapted to retain the bow string 12 of a typical bow 14 for holding and pulling the bow string as shown. In the preferred embodiment, the release includes a body 16 having a trigger 18 and a head 20, mounted on the body and including a string retaining notch and release mechanism as shown in FIGS. 2-7. An arrow 22 includes a nock 24 which is engaged by the bow string 12. In the preferred embodiment, the release 10 includes a pair of string retaining sear elements at 31, 31A spaced above and below the hock 24 of the arrow to maintain the string 12 substantially perpendicular to the axis of the arrow when the string is engaged and retained by the release. The body 16 may be of any desired configuration such as, by way of example, the palm grip shown in the drawings and/or a pistol grip or other known designs. Typically, a wrist strap 24 is included for securing the release 10 to the wrist of the user.

An enlarged plan view of a release in accordance with the invention is shown in FIG. 2, with the head 20 rotated 90° from the orientation shown in FIG. 1, and with the covers removed to expose the working mechanism. As there shown, the head 20 may be made of unitary molded construction including a cavity 28 adapted to receive and carry a pair of elongate sear elements 30, 31 each pivotable about a pivot post 32, 33, respectively, provided in the cavity 28. The outer ends 34, 35 of the sear elements include notches 36, 37 adapted for receiving the bow string. In the preferred embodiment, the outer ends 34, 35 of the sear elements 30, 31 are tapered or beveled as shown at 38, 39 to facilitate reception of the bow string 12 as it is entered into the notches 36, 37. The inner end 40 of the sear 30 includes a roller 41 mounted for rotation on the axis pin 42. A floating bearing 44 is carried in a socket defined by the complementary recesses 52 and 54 in the sear elements 30 and 31. The center of the bearing 44 is in alignment with the axes of the pivot posts 32 and 33 and acts to lock sear 31 in the closed position shown when the latch pin 60 is fully extended and the roller 41 is in engagement with the enlarged peripheral surface 62 of the latch pin.

When the latch pin is retracted by movement of the trigger 18, the roller rides up the tapered tip 66 of the latch pin, permitting the sear 30 to pivot from the closed position shown to the open position to release the bow string. As the sear 30 pivots open, the bearing 44 rides forward (to the right as shown in FIG. 3), with socket recess 52, simultaneously pushing the socket recess 54 of sear 31 in the forward direction to pivot the sear 31 outward and open. In this manner, the sears 30 and 31 move in unison about the respective pivots 32 and 33 between the opened and closed positions.

In the preferred embodiment, a tab 68 is provided on sear 30 behind and adjacent the notches 36 and 37. When a bow string is introduced into the notch, it engages the tab 68. By applying a force to the bow string, and thereby to the tab 68, the sears 30 and 31 are urged to the left as shown and pivot from the opened to the closed position, allowing the latch pin 60 to advance for locking the sears in the closed, string retaining position. A compression spring 70 is mounted in the head with opposite ends engaging the sears 30 and 31 for continuously urging the sears into the opened, string releasing position whenever the latch pin 60 is retracted.

The body 16 of the release may also be of unitary molded construction and includes a cavity 50 for carrying the latch mechanism 60 and the trigger 18. In the preferred embodiment, the body 16 and head 20 are mounted on a hollow cylindrical shaft or spool 72 and integral sleeve 74. The spool and/or sleeve include enlarged ends 76 and 78 which are received by complementary cavities in the body and head, respectively. When the covers (not shown) are secured to the body and head, the body, spool and head are maintained in assembled relationship. The elongate latch pin 60 extends through the central aperture 75 of the hollow spool and has one end 62 extending into the head for engaging the sear and the other end 80 extending into the body for engaging the trigger 18. End 62 of the latch pin terminates in a tapered conical tip 66 which is adapted for engaging the roller 41 on the sear 30. When the latch pin 60 is in its fully extended position as shown in FIG. 2, the full circumference of the enlarged portion 62 of the pin engages the roller 41 to maintain the sears 30, 31 in closed, string retaining position. When the pin is retracted into the body, the roller rides on the tapered tip 66, permitting the sear to pivot about the pivot pin post 32 and move from the closed to the open position to release the bow string, simultaneously opening sear 31, as described. The roller 41 provides a smooth opening action as the latch pin is retracted into the body.

The opposite end 80 of the latch pin 60 terminates in a threaded portion 82 which is adapted for receiving an adjusting knob 84. The trigger 18 includes a through aperture 86 for receiving the latch pin 60. The adjusting knob 84 is threadably received by the threaded end portion 82 of the latch pin for adjusting the travel required of the trigger 18 to move the latch pin from the fully extended position shown to the fully retracted position to permit opening of the sears 30, 31.

A set screw 88 Lay be provided in the adjusting knob 84 for locking the knob in position once the trigger is properly adjusted. In addition, a set screw 90 may be provided in the body 16 for engaging the perimeter of the spool end portion 78 to lock the rotational orientation between the head 16 and the body 20. In the preferred embodiment, compression spring 92 is provided in the spool 72 and engages the enlarged end 62 of the latch pin 60 to continuously urge the latch pin into the extended position for maintaining the sears 30, 31 in the closed, string retaining position. A second compression spring 93 is carried in the body and has one end in engagement with a retaining clip 95 which is carried by the latch pin 60. The other end of the spring 93 is in engagement with an abutment 96 provided in the body between the trigger 18 and the spool 76. The spring 93 provides biasing for urging the trigger 18 into engagement with the adjusting knob 84.

The trigger 18 is pivotable about the pivot post 98 provided in the cavity 50. When the trigger 18 is pulled back against the pivot post 98, the trigger engages the knob 84 and holds the pin 60, pulling the enlarged peripheral surface 62 and tapered surface 66 back into the head 16 (to the left as shown in FIG. 2), permitting the roller 41 to ride along the surface 66 of the pin, permitting the sear jaws 30 and 31 to open for releasing the string 12.

An alternative embodiment of the invention is shown in FIG. 3, wherein the head 20 is secured directly to a spool 172 having a reduced end portion 176. Typically, the head 20 is mounted in a fixed position on the spool. The body 16 is mounted for rotation about the spool 172. The enlarged end portion 178 of the spool 172 maintains the head 16 on the spool. The trigger pin 160 includes an enlarged end portion 162 having a radius 166 at its outer end for engaging the roller 41 of sear jaw 30. A central aperture 175 is provided in the spool 172 and is adapted to receive the enlarged end portion 162 of the pin 160. A reduced aperture 177 is provided in the enlarged end portion 178 of the spool. A single compression spring 192 is provided between the enlarged end portion 178 of the spool and the enlarged outer end 162 of the pin, for continuously urging the latch pin into the position shown in FIG. 3.

The trigger 118 of the embodiment of FIG. 3 is a free-floating trigger having a tapered through aperture 180 for receiving the pin 160. A turn knob 84 is provided, as in the embodiment of FIG. 2, and is adjustable for adjusting the maximum advancement of the pin 160 in response to movement of the trigger 118. The outer end 185 of knob 84 is a tapered, mounted element adapted to receive the tapered aperture 180 in the trigger 118 to provide for a smooth action of the trigger as the trigger is moved from the forward position shown in FIG. 3 to a retracted position to actuate the latch and release the sear jaws 30 and 31.

As is particularly shown in FIGS. 4 and 5, the enlarged end portion 178 of the spool is sectioned to provide rotational movement of the spool and hence the head 20 relative to the body 16 when the set screw 90 is advanced to its forwardmost position. As shown in FIG. 4, the body 16 shows the cover 17 in place to encapsulate the mechanism within the cavity 50. The sectioned enlarged end 178 is provided to permit limited movement of the spool 160 and head 20 relative to the body 16 by advancing the set screw 90 to a position beyond the outer periphery 179 of the enlarged end portion 178. A pair of walls 181 and 182 are formed on either side of the section for defining an open section 183. As can be seen, the spool 160 may be rotated between walls 181 and 183, providing limited calibration movement of the head relative to the body to accommodate the tendency of the user to hold the bow string release in a slightly different position on subsequent uses of the device.

A second section portion 185 is provided and defined by the end walls 187 and 189. This permits the bow string release of the subject invention to be used with a calibratable orientation range by both left-handed and right-handed archers. As shown in FIG. 5, the major portion 191 of the enlarged end 178 may be utilized to lock the bow string release in a specific position by locking the set screw 90 against the outer peripheral wall 179. Of course, it will be readily understood that the minor portion 193 of the enlarged end 178 may be utilized to lock the bow string release in a position as well.

Yet another embodiment of the subject invention is shown in FIGS. 6 and 7. As thereshown, the head 20 is mounted on the outer peripheral surface of a cylindrical spool 272 having an enlarged end 278. A central aperture 275 is adapted for slidably receiving the elongate cylindrical pin 260 having an enlarged cylindrical actuator end 266 adapted for engaging the cam roller 41. A compression spring 292 is provided between the actuator ends 266 and spool 272. As shown in FIG. 7, the cam 41 is mounted for rotation between the upper and lower portions 30 and 30a of the sear jaw. As thereshown, the head 20 includes the cover 21 for encapsulating the sear mechanism within the head.

The body 16 of the release includes a socket 216 for receiving a nylon bearing element 217. The nylon bearing element is mounted on the spool 272 and provides for smooth rotational action between the body 16 and the spool to adjust the rotational orientation of the body to the spool and head 20. The trigger 218 is mounted on a pivot post 98 provided in the body and includes a rounded through aperture 286 for receiving the pin 260. The roller knob 84 includes a spherical end section 285 which is adapted to be received by the rounded aperture 286 in the trigger, providing a smooth action between the pin 260 and the trigger 218 when the trigger 218 is actuated.

While certain embodiments and features of the invention have been described herein, it will be understood that the invention includes all alternative embodiments and modifications within the scope and spirit of the following claims.

What is claimed is:

1. A bow string release of the type having a head including a sear mechanism adapted for receiving and holding a bow string adjacent the nock of an arrow and selectively movable between a closed string retaining position and an open, string releasing position, a body attached to the head and including a trigger and latch mechanism for communicating the trigger with the sear mechanism and responsive to movement of the trigger to release the sear mechanism from the closed position to the open position, the improvement comprising:

a. at least one elongate sear pivotably mounted in the head and having an inner end and an outer end, said outer end including a string receptive notch for engaging and retaining a bow string;

b. a roller mounted for rotation on the inner end of said sear, the axis of rotation being substantially parallel to the line defined by said string when retained in said notch;

c. an elongate latch pin axially movable between an extended position and a retracted position in response to movement of said trigger, the pin axis being substantially perpendicular to the axis of rotation of said roller, said latch pin including a tapered end adapted for engaging said roller when the pin is in the extended position, for locking the sear in the string retaining position, whereby movement of the latch pin from the extended position to the retracted position permits the roller to ride on the tapered outer end of the pin for pivoting the sear from the closed, string retaining position to the open, string releasing position;

d. a second elongate sear pivotably mounted in the head and having an inner end and an outer end, said outer end including a string receptive notch complementary with the string retaining notch in said first elongate sear; and e. a floating bearing between and in abutting engagement with both of said elongate sears and in substantial alignment with the pivot points thereof, whereby said second elongate sear is maintained in the closed string retaining position when said first elongate sear is locked in the closed string retaining position by said latch pin, and said second elongate sear is pivoted to the open, string releasing position when said latch pin is retracted.

2. The release of claim 1, further including:

a. a hollow cylindrical spool having opposite ends;

b. said body mounted on one end of said spool for carrying the trigger;

c. the head mounted on the other end of said spool, said body and head selectively rotatable relative to one another;

d. said latch pin carried in said hollow spool and having one end extending into said head for engaging said sear and another end extending into said body for engaging said trigger.

3. The release of claim 1, including biasing means in engagement with said sear for continuously urging the sear into the open, string releasing position when said latch pin is retracted.

4. The release of claim 1, including biasing means in engagement with said latch pin for continuously urging said pin into the extended position.

5. The release of claim 1, including a tab on said sear and adjacent said notch for intercepting a bow string when said bow string is introduced into the notch, whereby application of a force on said bow string and against said tab urges the sear into the closed, string retaining position.

* * * * *